United States Patent [19]

Hoy

[11] Patent Number: 4,495,883

[45] Date of Patent: Jan. 29, 1985

[54] ADJUSTABLE DIVING PLATFORM

[76] Inventor: Paul E. Hoy, 4808 Escobar Ave., Naples, Fla. 33940

[21] Appl. No.: 514,571

[22] Filed: Jul. 18, 1983

[51] Int. Cl.[3] ..... B63B 17/00

[52] U.S. Cl. ..... 114/343; 114/362; 114/364

[58] Field of Search ..... 114/343, 362, 364; 182/53, 55, 62; 248/235, 240

[56] References Cited

U.S. PATENT DOCUMENTS

| | | | |
|---|---|---|---|
| 1,558,425 | 10/1925 | Yetter | 248/235 |
| 2,849,257 | 8/1958 | Woyton | 182/55 |
| 3,231,043 | 1/1966 | Brown | 182/55 |
| 4,320,816 | 3/1982 | Callahan | 182/55 |

*Primary Examiner*—Sherman D. Basinger
*Attorney, Agent, or Firm*—Merrill N. Johnson

[57] ABSTRACT

An adjustable diving platform for mounting on a boat which, despite the boat's freeboard or the contour of its hull, provides a stable horizontal diving platform at the waterline. The platform consists of a series of wooden slats on a rectangular frame. The platform is hingedly connected to the bottom of a vertical frame which includes a pair of telescoping hangers having crooked upper ends which are attached to the deck or gunwale of the boat. Adjustment of the telescoping hangers will position the platform at the waterline. The platform is also connected to the upper end of the vertical frame by a pair of flexible wires. The platform's frame includes a pair of telescoping rods with a footpad of resilient material at the end of each rod. By adjustment of these telescoping rods, the platform will lie securely at the waterline supported by its hinged connection to the bottom of the vertical frame, the two wires attached to the frame, and the two footpads pressed against the hull of the boat.

4 Claims, 4 Drawing Figures

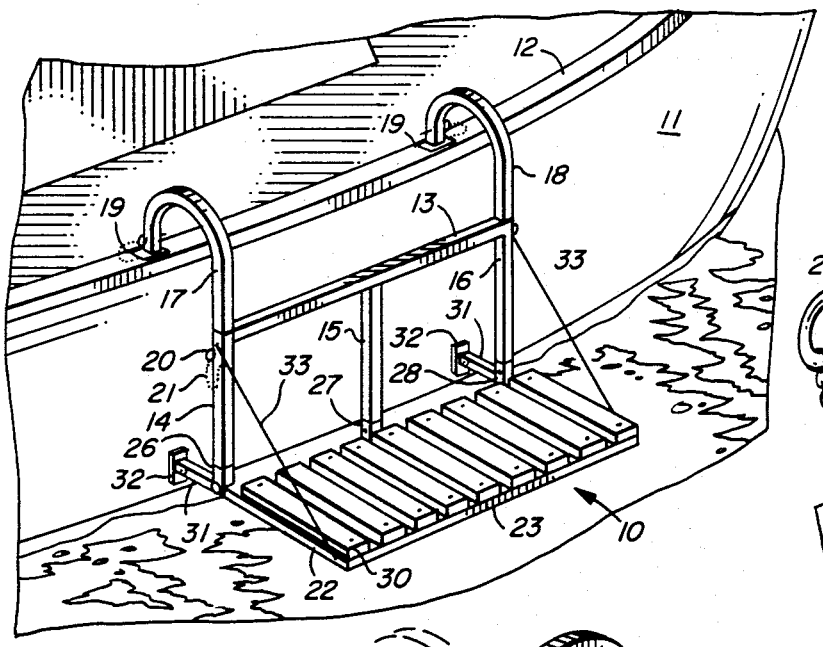
FIG. 1
FIG. 2
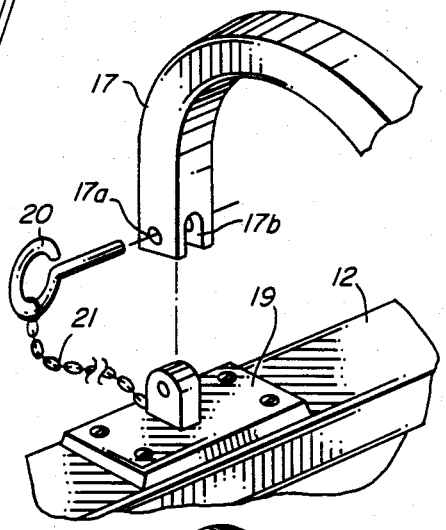
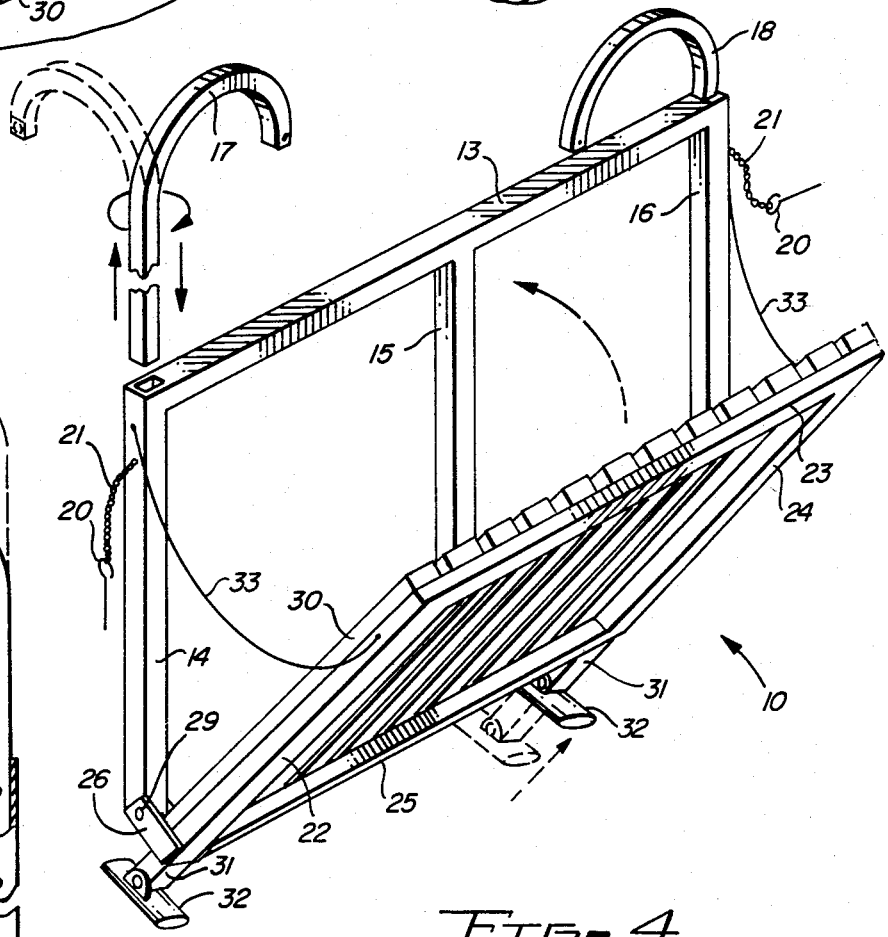
FIG. 4
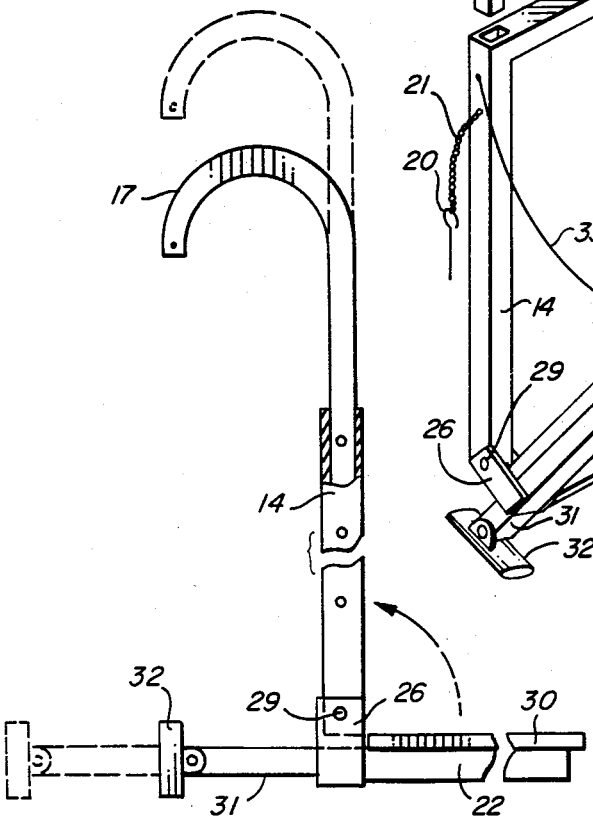
FIG. 3

ADJUSTABLE DIVING PLATFORM

BACKGROUND AND SUMMARY OF THE INVENTION

Boaters operating in deep water often desire a platform at the waterline from which such operations as scuba diving and swimming can take place. Such a platform should be removable and capable of being collapsed and stored in a small space when not in use. And since the freeboard and contour of the hull varies from boat to boat, the platform's supporting structure should be adjustable to permit the platform to lie securely at the waterline despite the boat's freeboard or the contour of its hull.

Various devices have been proposed for attachment to the side of a boat in order to facilitate a person and his gear to get into and out of the water. See, for example, the devices shown and described in U.S. Pat. No. 3,587,123 and 3,892,290.

However, all known prior art devices fail to provide what the scuba divers and swimmers most require, namely, an extended stable driving platform at the waterline. The platform should be strong enough and large enough to accommodate two sitting or standing swimmers or one scuba diver and his gear. The platform's supporting structure should be sufficiently adjustable so that the platform is secured at or slightly above the waterline despite the boat's freeboard or the contour of its hull. And finally, the platform must be easily removed and collapsed into a small space for storage when not in use.

It is an object of my invention to provide an extended stable platform at the waterline adjacent the hull of a boat from which swimmers or scuba divers can enter and return from the water. Even when operating in high seas off the Florida Keys, my platform affords easy access to and from the boat.

It is a further object of my invention to provide an adjustable diving platform at the side of a boat which can be removed and collapsed into a relatively small space for storage.

My dividing platform consists of a series of identical wooden slats mounted on a rectangular frame preferably constructed of anodized aluminum tubing square in cross-section. The platform is approximately 18 inches wide and 36 inches in length. This platform is supported at the waterline by a vertical frame suspended from the deck or gunwale of the boat.

The vertical frame is made principally of metal tubing square in cross-section and includes a horizontal support bar and at least two vertical support bars depending from the horizontal bar. One side of the diving platform is hingedly pinned to the bottom ends of each vertical support bar.

The vertical frame is hung from the boat by a pair of vertically telescoping hangers with crooked upper ends removably pinned to a pair of brackets screwed into the boat's deck or gunwale. By adjustment of these telescoping hangers, the platform can be positioned at or slightly above the waterline as desired regardless of the boat's freeboard.

A pair of multi-strand stainless steel wires extend from the vertical support bars to the front of the diving platform to support the platform in a horizontal plane at or parallel to the waterline.

The two side members of the platform's frame each house of telescoping rod. A further footpad having an outer covering a rubber or other resilient material is pivotably hinged to the outer end of each telescoping rod. By proper adjustment of these telescoping rods, the diving platform is spaced from the hull of the boat and secured in its horizontal plane at or parallel to the waterline. At the same time, the boat's hull is protected from damage by the supporting structure of the diving platform.

BRIEF DESCRIPTION OF THE DRAWINGS

FIG. 1 is a perspective view of a preferred embodiment of my adjustable diving platform mounted on the side of a boat.

FIG. 2 is a detailed partially broken away view of the platform of FIG. 1 showing how the platform is mounted on the boat's gunwale.

FIG. 3 is a side view of the platform in FIG. 1 partially broken away showing the vertical adjustment of one of the vertical hangers and also showing the horizontal adjustment of one of the hull-protecting footpads.

FIG. 4 is a perspective view of the platform in FIG. 1 showing the platform being folded up against the vertical supporting frame and also showing the two crooked hangers being turned 90° into position for storage.

DETAILED DESCRIPTION OF THE INVENTION

Referring to FIG. 1 of the drawings, a preferred embodiment of my unique diving platform 10 is shown mounted on the side of a boat 11. The diving platform itself is shown in a horizontal position slightly above the waterline.

The horizontal platform consists of a series of spaced wooden slats 30 mounted on a rectangular metal frame preferably made of hollow anodized aluminum tubing square in cross section. The frame includes left side member 22 and front member 23 best shown in FIG. 1 and right side member 24 and rear member 25 shown only in FIG. 4.

The diving platform is hingedly pinned to the bottom end of a vertical supporting frame. This frame consists of a horizontal support bar 13 and three vertical support bars 14, 15 and 16 welded to and depending from horizontal bar 13. All four bars are preferably of hollow metal tubing square in cross section. The frame is hung from the boat 11 by a pair of vertically telescoping hangers 17 and 18 made of solid metal barstock preferably square in cross section.

Hangers 17 and 18 have crooked or curved upper ends to facilitate suspending the diving platform from the deck or gunwale of the boat. The upper end of each hanger is drilled and grooved so that the hanger can be securely connected to a bracket screwed to the deck or gunwale of the boat as shown in FIG. 2.

A bracket 19 is screwed onto gunwale 12. A pin 20 is attached to bracket 19 by a stainless steel chain 21. The end of hanger 17 contains a drilled hole **17*a* and a groove 17*b*, which fits over a drilled projection on bracket 19. Insertion of pin 20 into hole 17*a*** will secure the diving platform along side the boat.

By adjustment of the telescoping hangers 17 and 18 within vertical support bars 14 and 16 respectively as shown in FIG. 3, the diving platform can be positioned at or slightly above the waterline despite the distance from gunwale 12 to the waterline, i.e., the boat's freeboard.

Although different arrangements for hingedly connecting the diving platform to the vertical frame have been used, FIGS. 3 and 4 show a preferred arrangement which includes brackets 26, 27 and 28 welded to members 23, 25 and 24 respectively of the rectangular frame of the platform. Each of the brackets is drilled to accommodate a pin 29 which hingedly connect the platform to the vertical frame.

A pair of multi-strand stainless steel wires 33 connected between the sides of bars 14 and 16 and the front of the diving platform will support the platform adjacent to the surface of the water.

Side members 22 and 24 of the bottom frame contain a pair of telescoping rods 31 and a footpad 32 pivotably mounted on the outer end of each rod 31. Each footpad has an outer covering made of rubber or similar resilient material. By adjustment of the two telescoping rods 31 within side members 22 and 24, footpads 32 will rest against the side of the boat and the diving platform will remain in a horizontal plane at or adjacent to the waterline regardless of the curvature or slope of the boat's hull.

Rods 31 are maintained in their desired position by removable pins similar to pins 20 shown in FIGS. 1, 2 and 4. The resilient covering on footpads 32 will rest firmly against the boat's hull without scarring or damaging the hull.

When hung from the boat and with rods 31 adjusted as shown in FIG. 1, my diving platform will safely and conveniently accommodate two side-by-side swimmers or one scuba diver and his gear. Even in rolling seas, the platform remains in stable position as swimmers or scuba divers enter or return from the water.

When the platform is no longer needed, pins 20 are withdrawn. The entire platform 10 can now be removed from boat side. Rods 31 are then retracted into members 22 and 24. Hangers 17 and 18 are withdrawn from support bars 14 and 16 respectively, turned 90° as shown in FIG. 4 and reinserted into bars 14 and 16. The diving platform is folded up as shown in FIG. 4 against the vertical frame. As is apparent, the collapsed platform 10 can now be easily transported by one person and stored in a very small space.

Having shown and described a preferred embodiment of my unique adjustable diving platform, changes and modifications of the structure and its essential components will be readily apparent to those skilled in the art. Accordingly the spirit and scope of my invention is limited only by the appended claims.

I claim:

1. An adjustable diving platform for mounting on a boat to provide a horizontal diving platform at the boat's waterline comprising a platform consisting of a series of slats mounted on a rectangular frame, a vertical frame consisting of a horizontal bar and a plurality of vertical bars depending from said horizontal bar, means including a plurality of pins for hingedly connecting the rear of the rectangular frame of the platform to the lower ends of the vertical bars of the vertical frame, a pair of hangers for suspending the diving platform from the boat, each of said hangers being in telescoping adjustment within one of the vertical bars of the vertical frame so as to position the platform along the side of the boat and adjacent the waterline, a pair of flexible wires connected between the upper end of the vertical frame and the front portion of platform's rectangular frame for supporting the platform in a horizontal plane adjacent the waterline, and a pair of rods having ends of resilient material for resting against the side of the boat, each of said rods being in telescoping adjustment within one of the two side members of the platform's rectangular frame.

2. An adjustable diving platform according to claim 1 in which a generally tubular footpad having an outer covering of resilient material is pivotably mounted on the end of each of the telescoping rods.

3. An adjustable diving platform according to claim 1 in which each of the pair of hangers has a crooked upper end which is pinned to a bracket affixed to the boat.

4. An adjustable diving platform to be mounted on a boat to provide a diving platform at the boat's waterline comprising a rectangular diving platform, a vertical frame which includes a plurality of hollow vertical bars, means for hingedly connecting one side of the diving platform to the lower ends of the vertical bars of the vertical frame, a pair of adjustable hangers for hanging the diving platform from the boat, each of said hangers being in telescoping adjustment with one of the hollow vertical bars so as to position the diving platform along the side of the boat adjacent the boat's waterline, a pair of flexible wires connected between the vertical frame and the diving platform for supporting the platform in a horizontal plane, and a pair of adjustable rods mounted on the diving platform and having ends designed to rest against the boat's hull, each of said rods being in telescoping adjustment with the diving platform.

* * * * *